US009743776B2

(12) United States Patent
Ray

(10) Patent No.: US 9,743,776 B2
(45) Date of Patent: Aug. 29, 2017

(54) MATTRESS LIFTING SYSTEM

(71) Applicant: Henry Ray, Bloomington, IL (US)

(72) Inventor: Henry Ray, Bloomington, IL (US)

( * ) Notice: Subject to any disclaimer, the term of this patent is extended or adjusted under 35 U.S.C. 154(b) by 67 days.

(21) Appl. No.: 14/711,940

(22) Filed: May 14, 2015

(65) Prior Publication Data

US 2016/0331146 A1 Nov. 17, 2016

(51) Int. Cl.

| | |
|---|---|
| ***A47C 21/02*** | (2006.01) |
| ***A47C 19/00*** | (2006.01) |
| ***A47C 19/02*** | (2006.01) |
| ***A61G 7/012*** | (2006.01) |
| ***A47C 19/04*** | (2006.01) |

(52) U.S. Cl.
CPC ..... *A47C 19/045* (2013.01)

(58) Field of Classification Search
CPC ..... A47C 21/02; A47C 21/028; A47C 19/00; A47C 19/02
USPC ..... 5/611, 11, 488, 510, 937
See application file for complete search history.

(56) References Cited

U.S. PATENT DOCUMENTS

| | | | | |
|---|---|---|---|---|
| 1,058,076 | A * | 4/1913 | Loweree | 5/611 |
| 4,556,198 | A * | 12/1985 | Tominaga | 254/122 |
| 4,681,308 | A * | 7/1987 | Rice | 5/601 |
| 5,013,018 | A * | 5/1991 | Sicek et al. | 5/601 |
| 5,022,105 | A * | 6/1991 | Catoe | 5/11 |
| D345,473 | S | 3/1994 | Grundmann | |
| 5,414,882 | A | 5/1995 | Goodale | |
| 5,497,518 | A | 3/1996 | Iura | |
| 5,738,306 | A * | 4/1998 | Moss et al. | 244/137.2 |
| 5,779,296 | A * | 7/1998 | Hewko | 296/19 |
| 6,094,760 | A * | 8/2000 | Nonaka et al. | 5/601 |
| 6,457,196 | B1 | 10/2002 | Dykes et al. | |
| 6,516,478 | B2 * | 2/2003 | Cook et al. | 5/611 |
| 6,584,629 | B2 * | 7/2003 | Tsuji et al. | 5/618 |
| 6,941,594 | B1 * | 9/2005 | Mosley | 5/11 |
| 6,951,037 | B2 * | 10/2005 | Weinman et al. | 5/618 |
| 7,292,673 | B2 * | 11/2007 | Kroner et al. | 378/20 |
| 7,681,260 | B2 * | 3/2010 | Hallock et al. | 5/425 |
| 7,686,319 | B1 * | 3/2010 | Fink | 280/304.1 |
| 8,006,331 | B1 | 8/2011 | Scarleski | |
| 8,104,123 | B2 * | 1/2012 | Paz et al. | 5/624 |
| 8,578,529 | B2 * | 11/2013 | Miyano et al. | 5/601 |
| 8,671,475 | B2 * | 3/2014 | Radzinsky | 5/89.1 |
| 2007/0283494 | A1 * | 12/2007 | Vasey | 5/488 |
| 2010/0064439 | A1 * | 3/2010 | Soltani | 5/611 |
| 2011/0030136 | A1 * | 2/2011 | Kim | 4/547 |

FOREIGN PATENT DOCUMENTS

| | | |
|---|---|---|
| WO | WO2014147003 | 9/2014 |

* cited by examiner

*Primary Examiner* — Peter M Cuomo
*Assistant Examiner* — Ifeolu Adeboyejo

(57) ABSTRACT

A mattress lifting system includes a bed that includes a mattress, a frame and a headboard. The mattress rests on the frame. A lifting unit is positioned beneath the mattress and the lifting unit is movable beneath the mattress. The lifting unit includes a rotating portion. The lifting unit is positionable in a raised position such that the rotating portion engages and lifts the mattress off of the frame. The lifting unit is movable when the lifting unit lifts the mattress thereby facilitating the mattress to be rotated without contacting the headboard. The lifting unit is positionable in a lowered position such that the rotating portion is spaced from the mattress such that the mattress rests on the frame.

8 Claims, 6 Drawing Sheets

MATTRESS LIFTING SYSTEM

BACKGROUND OF THE DISCLOSURE

Field of the Disclosure

The disclosure relates to lifting devices and more particularly pertains to a new lifting device for lifting and rotating a mattress.

SUMMARY OF THE DISCLOSURE

An embodiment of the disclosure meets the needs presented above by generally comprising a bed that includes a mattress, a frame and a headboard. The mattress rests on the frame. A lifting unit is positioned beneath the mattress and the lifting unit is movable beneath the mattress. The lifting unit includes a rotating portion. The lifting unit is positionable in a raised position such that the rotating portion engages and lifts the mattress off of the frame. The lifting unit is movable when the lifting unit lifts the mattress thereby facilitating the mattress to be rotated without contacting the headboard. The lifting unit is positionable in a lowered position such that the rotating portion is spaced from the mattress such that the mattress rests on the frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
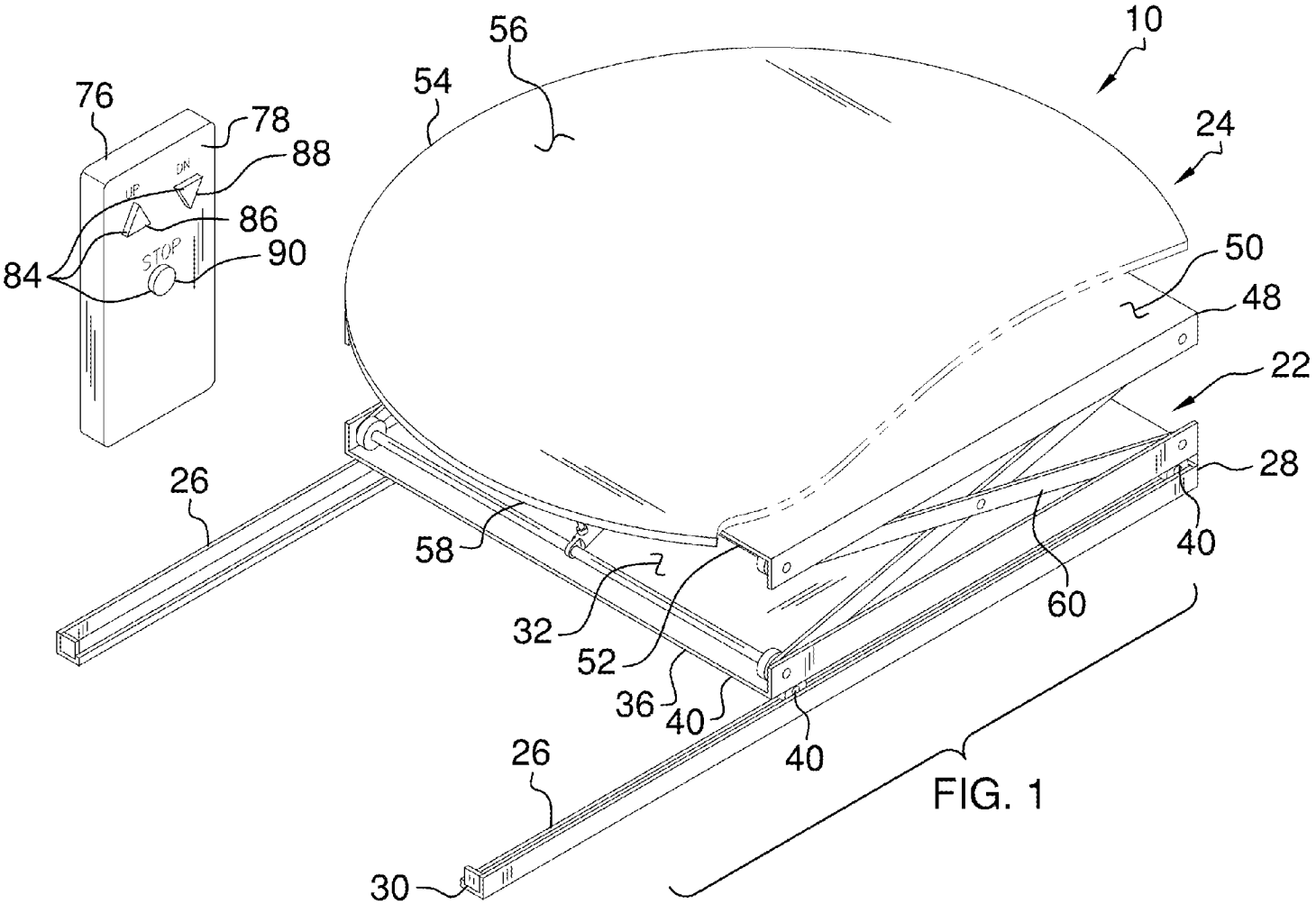
FIG. 1 is a perspective view of a mattress lifting system according to an embodiment of the disclosure.
Figure 2:
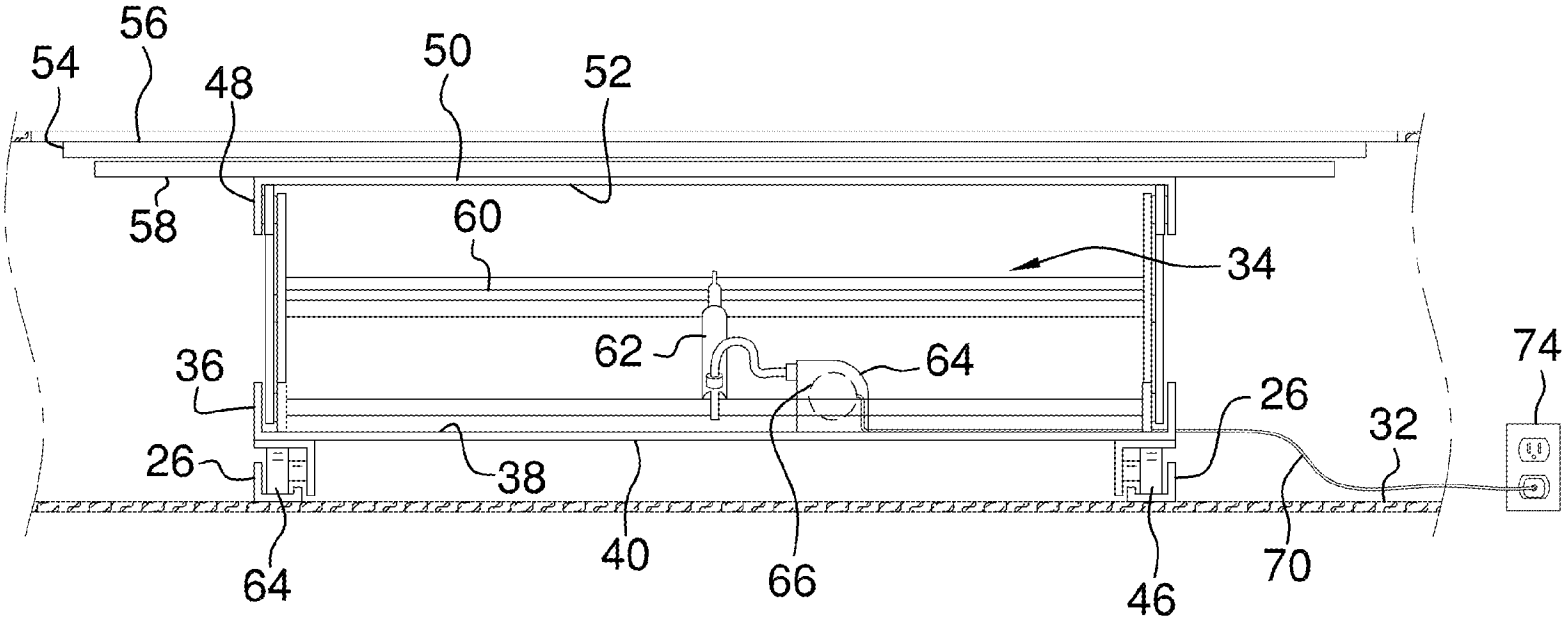
FIG. 2 is a front view of an embodiment of the disclosure.
Figure 3:
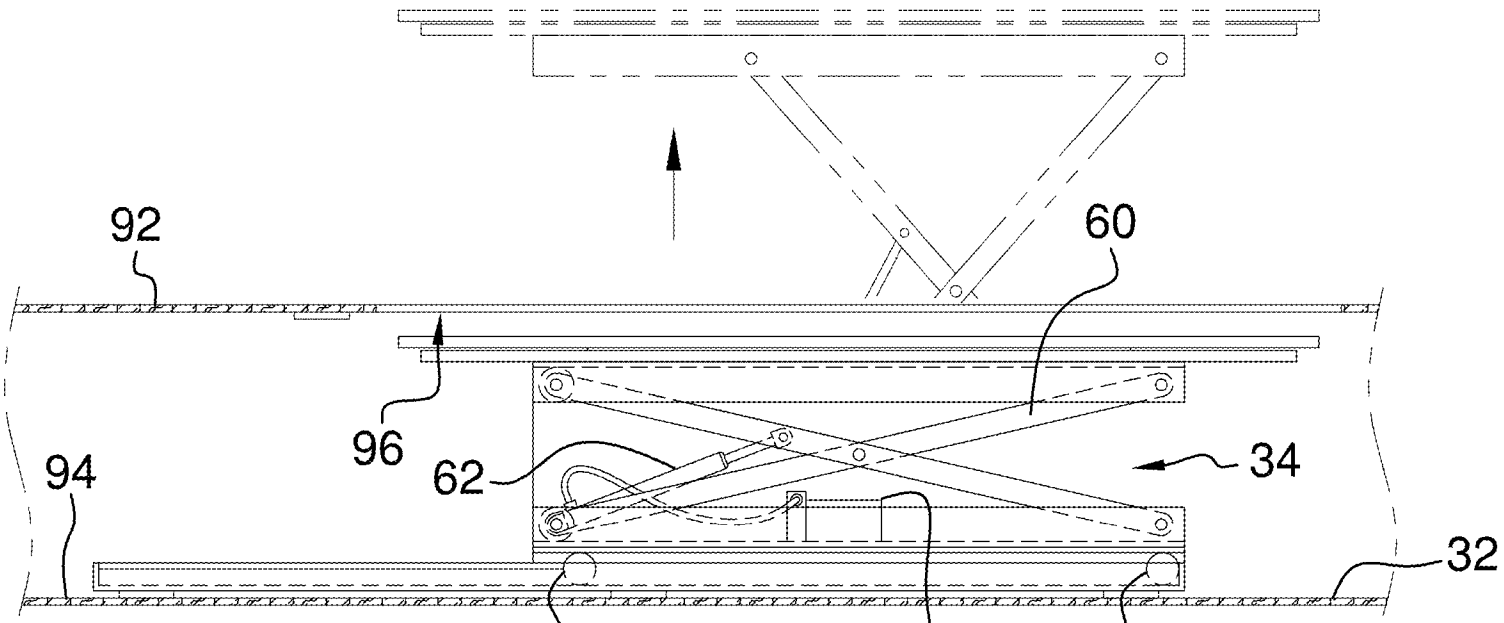
FIG. 3 is a left side view of an embodiment of the disclosure.
Figure 4:
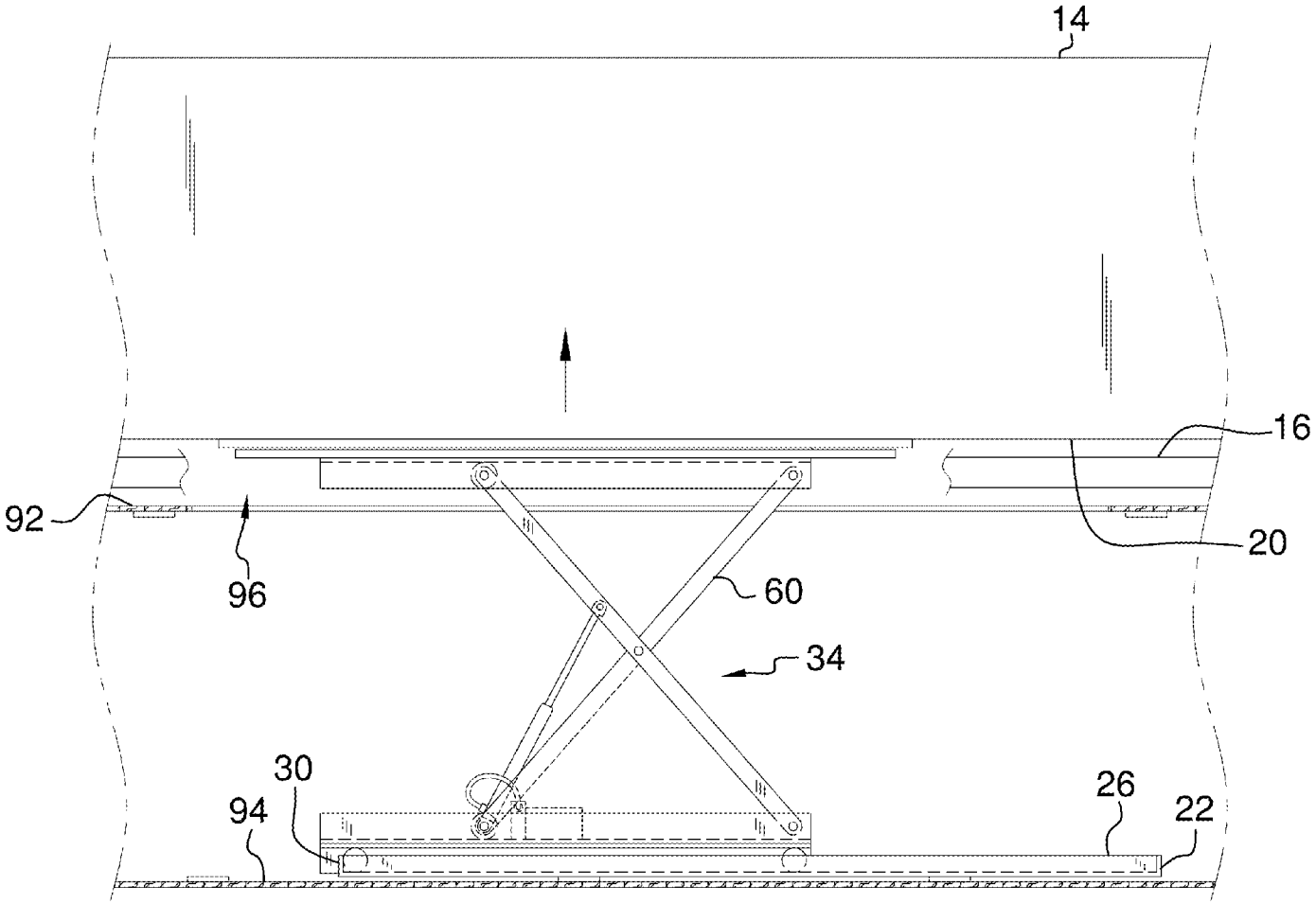
FIG. 4 is a perspective in-use view of an embodiment of the disclosure.
Figure 5:
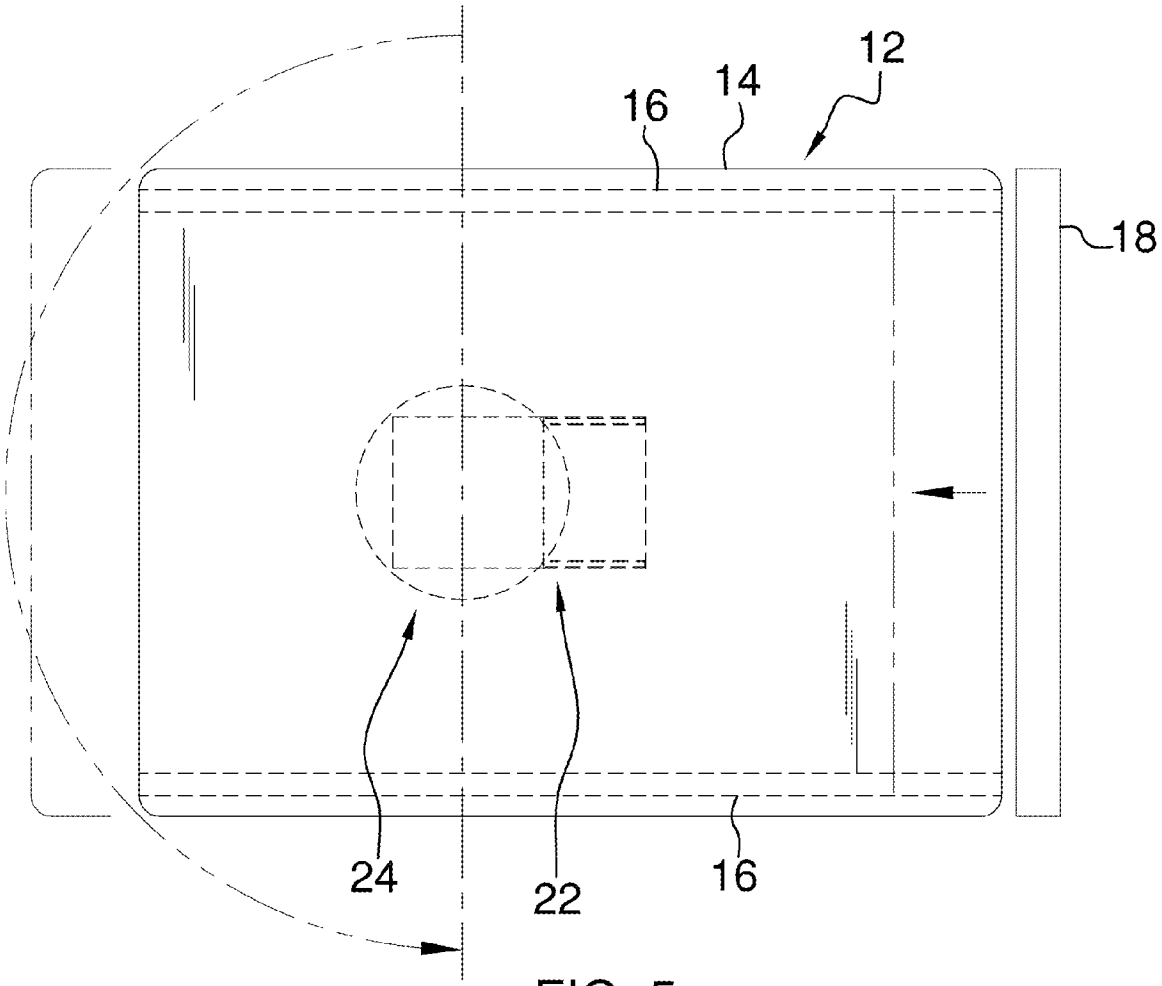
FIG. 5 is a top view of an embodiment of the disclosure.
Figure 6:
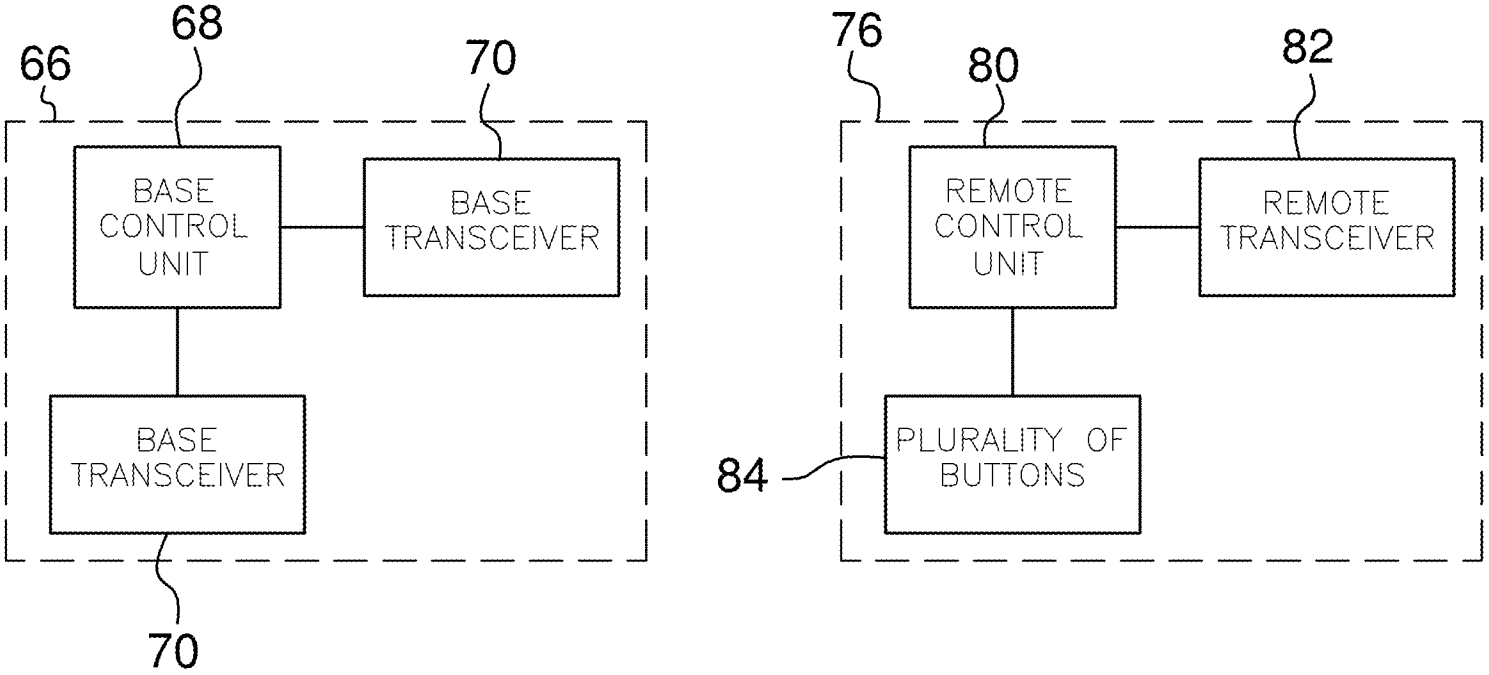
FIG. 6 is a schematic view of an embodiment of the disclosure.

With reference now to the drawings, and in particular to FIGS. 1 through 6 thereof, a new lifting device embodying the principles and concepts of an embodiment of the disclosure and generally designated by the reference numeral 10 will be described.

As best illustrated in FIGS. 1 through 6, the mattress lifting system 10 generally comprises a bed 12 that includes a mattress 14, a frame 16 and a headboard 18. The mattress

14 has a lower surface 20 and the mattress 14 rests on the frame 16. The bed 12 may comprise a sleeping bed or the like.

A lifting unit 22 is positioned beneath the mattress 14 and the lifting unit 22 is movable beneath the mattress 14. The lifting unit 22 includes a rotating portion 24. The lifting unit 22 is positionable in a raised position such that the rotating portion 24 engages and lifts the mattress 14 off of the frame 16. The lifting unit 22 is movable when the lifting unit 22 lifts the mattress 14 thereby facilitating the mattress 14 to be rotated without contacting the headboard 18. The lifting unit 22 is positionable in a lowered position having the rotating portion 24 being spaced from the mattress 14 such that the mattress 14 rests on the frame 16.

The lifting unit 22 comprises a pair of tracks 26 and each of the tracks 26 has a first end 28 and a second end 30. Each of the tracks 26 may be positioned on a support surface 32 having each of the tracks 26 being spaced apart from each other. Each of the tracks 26 is oriented beneath the mattress 14 and the support surface 32 may be a floor or the like.

A jack 34 is slidably positioned on the tracks 26 and the jack 34 comprises a base 36 that has a top surface 38 and a bottom surface 40. A plurality of rollers 42 is provided and each of the rollers 42 is rotatably coupled to the bottom surface 40 of the base 36. The plurality of rollers 42 comprises a first set of rollers 44 and a second set of rollers 46. Each of the first set of rollers 44 and the second set of rollers 46 roll along an associated one of the tracks 26 such that the base 36 is movable between the first end 28 and the second end 30 of each of the tracks 26.

A platform 48 is provided that has an upper surface 50 and a lower surface 52. A table 54 is provided that has a topmost surface 56 and a lowermost surface 58. The lowermost surface 58 is rotatably coupled to the upper surface 50 of the platform 48. A scissor lift 60 is coupled between the top surface 38 of the base 36 and the lower surface 52 of the platform 48.

The scissor lift 60 is positionable between a raised position and a lowered position. The topmost surface 56 of the table 54 engages the lower surface 20 of the mattress 14 when the scissor lift 60 is positioned in the raised position such that the mattress 14 is lifted above the frame 16. The lowermost surface 58 of the table 54 is spaced from the lower surface 20 of the mattress 14 when the scissor lift 60 is positioned in the lowered position such that the mattress 14 rests on the frame 16.

An actuator 62 is attached between the base 36 and the scissor lift 60. The actuator 62 urges the scissor lift 60 between the raised position and the lowered position. The actuator 62 may comprise a hydraulic cylinder or the like. A pump 64 is attached to the base 36 and the pump 64 is in fluid communication with the actuator 62. The pump 64 may be a hydraulic pump or the. Thus, the pump 64 provides a hydraulic pressure to the actuator 62.

A control 66 is in communication with the jack 34 and the control 66 is electrically coupled to the pump 64 such that the control 66 actuates and de-actuates the pump 64. The control 66 comprises a base control circuit 68 and a base transceiver 70 that is electrically coupled to the base control circuit 68. The base transceiver 70 may comprise a radio frequency transceiver or the like. A base power supply 72 is electrically coupled to the base control circuit 68 and the base power supply 72 may be electrically coupled to a power source 74. The power source 74 may be an electrical outlet or the like.

A remote unit 76 is provided that has a front side 78. A remote control circuit 80 is positioned within the remote unit 76 and a remote transceiver 82 is positioned within the remote unit 76. The remote transceiver 82 is electrically coupled to the remote control circuit 80 and the remote transceiver 82 is in electrical communication with the base transceiver 70. The remote transceiver 82 may comprise a radio frequency transceiver or the like.

A plurality of buttons 84 is positioned on the front side 78 of the remote unit 76 such that each of the buttons 84 may be manipulated. Each of the buttons 84 is electrically coupled to the remote control circuit 80. Thus, each of the buttons 84 controls operational functions of the jack 34. The buttons 84 may include an up button 86, a down button 88 and a stop button 90.

The bed 12 may be positioned on a floor 92 and the lifting unit 22 may be positioned on a foundation 94 that is positioned beneath the floor 92. The floor 92 may have an opening 96 that is positioned beneath the bed 12. The lifting unit 22 may be aligned with the opening 96 such that the lifting unit 22 extends upwardly through the opening 96 to lift the mattress 14 when the lifting unit 22 is positioned in the raised position. The lifting unit 22 may recede beneath the floor 92 when the lifting unit 22 is positioned in the lowered position such that the lifting unit 22 is concealed with respect to the floor 92.

In use, the up button 86 is manipulated to lift the mattress 14 upwardly from the frame 16. The mattress 14 is manipulated such that the jack 34 slides along each of the tracks 26 thereby facilitating the mattress 14 to be spaced from the headboard 18. The mattress 14 is manipulated to be rotated 180° with respect to the headboard 18. The mattress 14 is manipulated such that the jack 34 slides on each of the tracks 26 thereby facilitating the mattress 14 to be positioned adjacent to the headboard 18. The down button 88 is manipulated to lower the mattress 14 onto the frame 16.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mattress lifting system configured to lift a mattress thereby facilitating the mattress to be rotated, said system comprising:
- a bed including a mattress, a frame and a headboard, said mattress resting on said frame; and
- a lifting unit being positioned beneath said mattress, said lifting unit being movable beneath said mattress, said lifting unit including a rotating portion, said lifting unit being positionable in a raised position wherein said rotating portion engages and lifts said mattress off of said frame, said lifting unit being movable when said lifting unit lifts said mattress thereby facilitating said mattress to be rotated without contacting said headboard, said lifting unit being positionable in a lowered position wherein said rotating portion is spaced from said mattress such that said mattress rests on said frame, wherein said lifting unit comprises a pair of tracks, each of said tracks having a first end and a second end, each of said tracks being configured to be positioned on a support surface having each of said tracks being spaced apart from each other, each of said tracks being oriented beneath said mattress, said lifting unit further comprising a jack being slidably positioned on said tracks, said jack comprising:
  - a base having a top surface and a bottom surface; and
  - a plurality of rollers, each of said rollers being rotatably coupled to said bottom surface of said base, said plurality of rollers comprising a first set of rollers and a second set of rollers, each of said first set of rollers and said second set of rollers rolling along an associated one of said tracks wherein said base is movable between said first end and said second end of each of said tracks.

2. The system according to claim 1, further comprising:
- a platform having an upper surface and a lower surface; and
- a table having a topmost surface and a lowermost surface, said lowermost surface being rotatably coupled to said upper surface of said platform.

3. The system according to claim 2, further comprising:
- a base having a top surface;
- a platform having a lower surface;
- said mattress having a lower surface; and
- a scissor lift being coupled between said top surface of said base and said lower surface of said platform, said scissor lift being positionable between a raised position and a lowered position, said topmost surface of said table engaging said lower surface of said mattress when said scissor lift is positioned in said raised position wherein said mattress is lifted above said frame, said lowermost surface of said table being spaced from said lower surface of said mattress when said scissor lift is positioned in said lowered position wherein said mattress rests on said frame.

4. The system according to claim 3, further comprising an actuator being attached between said base and said scissor lift, said actuator urging said scissor lift between said raised position and said lowered position.

5. The system according to claim 1, further comprising:
- a jack;
- an actuator; and
- a control being in communication with said jack, control being electrically coupled to said actuator wherein said control actuates and de-actuates said actuator, said control comprising:
  - a base control circuit;
  - a base transceiver being electrically coupled to said base control circuit; and
  - a base power supply being electrically coupled to said base control circuit, said base power supply being configured to be electrically coupled to a power source.

6. The system according to claim 1, further comprising:
- a base transceiver;
- a remote unit having a front side;

a remote control circuit positioned within said remote unit; and a remote transceiver being positioned within said remote unit, said remote transceiver being electrically coupled to said remote control circuit, said remote transceiver being in electrical communication with said base transceiver.

7. The system according to claim 6, further comprising:

a jack; and a plurality of buttons being positioned on said front side of said remote unit wherein each of said buttons is configured to be manipulated, each of said buttons being electrically coupled to said remote control circuit wherein each of said buttons controls operational functions of said jack.

8. A mattress lifting system configured to lift a mattress thereby facilitating the mattress to be rotated, said system comprising:

a bed including a mattress, a frame and a headboard, said mattress having a lower surface, said mattress resting on said frame; and a lifting unit being positioned beneath said mattress, said lifting unit being movable beneath said mattress, said lifting unit including a rotating portion, said lifting unit being positionable in a raised position wherein said rotating portion engages and lifts said mattress off of said frame, said lifting unit being movable when said lifting unit lifts said mattress thereby facilitating said mattress to be rotated without contacting said headboard, said lifting unit being positionable in a lowered position wherein said rotating portion is spaced from said mattress such that said mattress rests on said frame, said lifting unit comprising:

a pair of tracks, each of said tracks having a first end and a second end, each of said tracks being configured to be positioned on a support surface having each of said tracks being spaced apart from each other, each of said tracks being oriented beneath said mattress, a jack being slidably positioned on said tracks, said jack comprising:

a base having a top surface and a bottom surface, a plurality of rollers, each of said rollers being rotatably coupled to said bottom surface of said base, said plurality of rollers comprising a first set of rollers and a second set of rollers, each of said first set of rollers and said second set of rollers rolling along an associated one of said tracks wherein said base is movable between said first end and said second end of each of said tracks, a platform having an upper surface and a lower surface, a table having a topmost surface and a lowermost surface, said lowermost surface being rotatably coupled to said upper surface of said platform, a scissor lift being coupled between said top surface of said base and said lower surface of said platform, said scissor lift being positionable between a raised position and a lowered position, said topmost surface of said table engaging said lower surface of said mattress when said scissor lift is positioned in said raised position wherein said mattress is lifted above said frame, said lowermost surface of said table being spaced from said lower surface of said mattress when said scissor lift is positioned in said lowered position wherein said mattress rests on said frame, an actuator being attached between said base and said scissor lift, said actuator urging said scissor lift between said raised position and said lowered position, and a control being in communication with said jack, control being electrically coupled to said actuator wherein said control actuates and de-actuates said actuator, said control comprising:

a base control circuit, a base transceiver being electrically coupled to said base control circuit, a base power supply being electrically coupled to said base control circuit, said base power supply being configured to be electrically coupled to a power source, a remote unit having a front side, a remote control circuit positioned within said remote unit, a remote transceiver being positioned within said remote unit, said remote transceiver being electrically coupled to said remote control circuit, said remote transceiver being in electrical communication with said base transceiver, and a plurality of buttons being positioned on said front side of said remote unit wherein each of said buttons is configured to be manipulated, each of said buttons being electrically coupled to said remote control circuit wherein each of said buttons controls operational functions of said jack.

* * * * *